US008747200B2

(12) United States Patent
Klitsner et al.

(10) Patent No.: US 8,747,200 B2
(45) Date of Patent: Jun. 10, 2014

(54) CAPTURE GAME APPARATUS

(75) Inventors: Dan Klitsner, Larkspur, CA (US); Hakan Diniz, Springfield, MA (US)

(73) Assignees: Hasbro, Inc., Pawtucket, RI (US); Kid Group, LLC, Larkspur, CA (US)

( * ) Notice: Subject to any disclaimer, the term of this patent is extended or adjusted under 35 U.S.C. 154(b) by 287 days.

(21) Appl. No.: 13/246,108

(22) Filed: Sep. 27, 2011

(65) Prior Publication Data

US 2013/0079074 A1 Mar. 28, 2013

(51) Int. Cl.
*A63F 9/24* (2006.01)

(52) U.S. Cl.
USPC ..... 463/7; 463/20

(58) Field of Classification Search
USPC ..... 463/7, 20
See application file for complete search history.

(56) References Cited

U.S. PATENT DOCUMENTS

| | | | | |
|---|---|---|---|---|
| 4,207,087 | A | 6/1980 | Morrison et al. | |
| 4,261,563 | A | 4/1981 | Goldfarb | |
| 4,285,517 | A | 8/1981 | Morrison | |
| 4,298,198 | A | 11/1981 | Huang et al. | |
| 4,322,073 | A | 3/1982 | Slavik et al. | |
| 4,326,710 | A | 4/1982 | Breslow et al. | |
| 4,339,135 | A | 7/1982 | Breslow et al. | |
| 4,913,432 | A | 4/1990 | Barra | |
| 5,060,941 | A | 10/1991 | Barra | |
| 5,685,776 | A | 11/1997 | Stambolic et al. | |
| 5,743,796 | A | 4/1998 | Orak et al. | |
| 5,992,849 | A | 11/1999 | Olti et al. | |
| 6,086,478 | A | 7/2000 | Klitsner et al. | |
| 6,186,504 | B1 | 2/2001 | Maxim | |
| 6,210,278 | B1 | 4/2001 | Klitsner | |
| 6,959,871 | B1 * | 11/2005 | Herrod et al. | 235/462.13 |
| 7,044,857 | B1 | 5/2006 | Klitsner et al. | |
| 2006/0166745 | A1 | 7/2006 | Lo | |
| 2012/0033429 | A1 * | 2/2012 | Van De Ven | 362/294 |
| 2013/0217494 | A1 * | 8/2013 | Wols et al. | 463/31 |

OTHER PUBLICATIONS

PCT/US2012/056470—International Search Report. dated Jan. 23, 2013.

PCT/US2012/056470—Written Opinion of the International Searching Authority. dated Jan. 23, 2013.

PCT/US2012/056470—Notification of Transmittal of the International Search Report and the Written Opinion of the International Searching Authority or the Declaration. Jan. 23, 2013.

* cited by examiner

*Primary Examiner* — Pierre E Elisca
(74) *Attorney, Agent, or Firm* — Perry Hoffman

(57) ABSTRACT

An electronic hand held capture-the-light game apparatus in which the apparatus includes a controller, eleven light sources in a linear display and two oppositely disposed movable handles. One of the handles activates a compression switch when the handles are pressed together. The controller is programmed to include a series of games to be played on the apparatus that become progressively more difficult. The games provide that the light sources are momentarily illuminated in a predetermined sequence at a predetermined tempo, and object of the game for a player is to activate the compression switch when one of three light sources in a capture zone is illuminated. If successful, the player earns a reward, if not, the player loses one of a limited number of chances to continue the game.

20 Claims, 6 Drawing Sheets

CAPTURE GAME APPARATUS

FIELD OF THE INVENTION

The present invention relates generally to a hand held electronic game apparatus, and, more particularly, to a capture-the-light hand held electronic game apparatus that illuminates for very short durations one or more of a plurality of light sources that are energized in predetermined sequences; a player is required to "capture" a specific light source by quickly closing a switch to stop the sequence when that specific light source is illuminated.

BACKGROUND OF THE INVENTION

Game apparatus that require fast reactive responses by players are fun to play and often very competitive. Such games have been patented in the past but leave room for new games that offer more and/or different challenges and greater excitement. New and fresh features for games are desirable but creating and developing such features in a successful manner have often proven difficult.

As mentioned, hand held electronic games are disclosed in earlier patents as recited below. For example, U.S. Pat. No. 4,261,563 for an "Electronic Time Reaction Game" issued in 1981 to Goldfarb purports to disclose a time reaction game where a microprocessor in an apparatus having two sets of lights, one for each of two players, initiates a game cycle by first generating a ready signal, either from a speaker or from the lights, or both, then delaying for a varying time interval, the interval being unknown to the players, and thereafter generating a start signal, either from the speaker or the lights, or both. The object of the game is to play enough cycles for one player to activate all of the lights of his set of lights before his opponent can activate all of his set of lights. Once the start signal is issued the players attempt to manually depress a response switch before his opponent can do so to win a score. In one embodiment, each player has two response switches from which to choose activation. One switch activates a light from the player's set of lights while the other switch deactivates a light from his opponent's set of lights. In the same year, U.S. Pat. No. 4,298,198 issued for an "Electronic Game Apparatus For A Single Player or Opposing Players" to Huang and Ling-Huang, and purports to disclose an elongated box with a series of lights, sixteen are shown, and several switches. A switch is depressed to cause one of two lights to glow, the two lights being several lights away from an end of the series of lights. Depending on which light is illuminated, one of the players must depress another switch to energize a streak of lights to begin. Succeeding lights are quickly energized giving the impression that the lights are moving toward one of the ends of the series of lights. The object of the game is to have the players alternately react quickly enough to prevent the streak from energizing the end light nearest him/her such that the light streak moves back and forth between the players. The back and forth streaking will continue until one of the players fails to react quickly enough, whereupon an end light is energized, the game ends, and the other player wins or score a point.

In 1982, a U.S. Patent issued to Breslow and Erickson, U.S. Pat. No. 4,326,710, for a "Talking Electronic Game" purporting to include an integrated circuit voice synthesizer to generate a plurality of first partial phrases, each forming the beginning of a complete phrase, and a plurality of second partial phrases, each forming the end of a complete phrase. The beginning and ending phrases are assigned at random to a plurality of push buttons, and the object of the game is to match up, from memory, the beginning and ending phrases of various complete phrases by appropriate actuation of the various push buttons. The winner is the player who matches all of the partial phrases correctly with the fewest number of incorrect match ups. Another U.S. Pat. No. 4,913,432 issued in 1990 for an "Electromechanical Reaction-Time Game Toy" to Barra, and purports to disclose another reaction type game where a trigger or push button is attached to a drive such as a stretched rubber band mounted in a box. The drive is also attached to pointers movable along marked panels mounted on opposite longitudinal sides of the box. The marks on the panels, which are randomly arranged, serve to indicate values such as numbers or baseball indicia. Depressible stop buttons are also mounted along the sides of the box. The game starts when the trigger is rotated so as to release the rubber band causing the pointers to move quickly along the panels. The player uses the depressible buttons to stop the pointers at a desirable location along the panel in order to achieve the highest number or run score. An electrical embodiment may use a series of lights instead of the pointers to indicate motion along the box.

A year later, Barra received U.S. Pat. No. 5,060,941 for an "Electronic Reaction-Time Game Toy" which operated as the device disclosed in his first mentioned patent but is electronically based. U.S. Pat. No. 5,685,776 issued to Stambolic and others in 1997 for a "Hand-Held Electronic Game Devices", and purports to disclose hand-held electronic game devices having elongated tubular forms with a centrally mounted electronic displays and various types of controls at either end of the tubes, such as push buttons, pull switches, rotary switches, toggle switches, spring-loaded balls, flip switches, momentary switches, slides switches, twist knobs, mouse controls, pointer balls, and lever arms. The game also includes a computer that is operated by the controls, a display and a speaker. The pull switches include return springs. One embodiment shown in FIG. 6, is a game intended to be held in a horizontal orientation such that the end handles may be twisted and pushed inwards by both hands of a player, allowing the game to be manipulated to effect play. The games disclosed include displays with an amoeba moving through a hostile environment, a shark attempting to "eat" as many fish as possible while avoiding dangerous situations, a man on a pogo stick attempting to save a city from high flying buzzards, various shapes which must be capture and correctly united, a motocross moving across while avoiding obstacles, and a martial arts fighter and his opponents.

In 2000 Klitsner and Welch were issued U.S. Pat. No. 6,086,478 for a "Hand-Held Voice Game" purporting to disclose a game device having an elongated housing with a controller, a speaker and three different input switches, a pressure switch pressed by a player, a pull knob and a twist knob. The game starts with an audible signal that relates to one of the input switches. After actuation of the selected input switch, the controller will issue a second audible signal relating to one of the three switches that must be actuated by the player within a predetermined time. If the player is successful the game goes on. If the player does not actuate the correct switch within the allotted time an error signal is issued. Another patent issued to Klitsner a year later, U.S. Pat. No. 6,210,278, also entitled "Hand-Held Voice Game". This second patent is a continuation-in-part of the 2000 patent and additionally discloses a game with two curved handles, a controller, a speaker and five input devices, a pressure switch, a pull knob, a twist knob, a spin switch and a lever switch. The game is played as described for the device in the 2000 patent. A third U.S. Patent issued to Klitsner, along with Clemens and Levenberg, in 2006, U.S. Pat. No. 7,044,857, is for a "Hand-Held Musical Game" in which the game apparatus is formed as a stylized guitar with a body portion and a neck portion. The neck portion is rotatable relative to the body portion, the body portion includes a strum bar, and there is a slide element movable along the neck portion. Electronics are in the apparatus to provide audio and/or visual instructions to a player to rotate the neck portion, move the slide element or manipulate the strum bar in a predetermined period of time.

All of the game apparatus mentioned above are of interest but none of them provide the play value of the invention described in detail herein.

SUMMARY OF THE INVENTION

In accordance with the present invention, an advantageous method and apparatus are disclosed in the form of an electronic hand held game for "capturing a moving light." The "light," one of a series of momentarily illuminated light sources, is "moved" by a controller, such as a programmed microprocessor and ancillary electronics, in predetermined sequences or patterns. Each pattern is created by having the light sources individually illuminate or energize, but only for short predetermined durations, at predetermined tempos. A player of the game must react quickly and stop the sequence when a light source at a predetermined specific location is energized. The light capture game apparatus is held in a player's hands so that he/she is able to view all of the light sources. Stopping the light sequence successfully requires that the concentrating player quickly activate a switch by squeezing the apparatus. The game apparatus also has the advantages of being relatively simple, fun to use, safe, relatively inexpensive, compact and yet, structurally robust.

Briefly summarized, the invention relates to a capture-the-light game apparatus including a housing having a plurality of separately mounted light sources in an extended arrangement, a first handle connected to the housing, a biasing element connected to the first handle and to the housing, a second handle connected to the housing, a switch operatively connected to the light sources, the switch being activated by a player of the game apparatus by movement of the first handle, a compartment for mounting a power source, the compartment being operatively connected to the light sources and to the switch, and a controller connected to the power source compartment, the switch and the light sources to enable the plurality of light sources to be illuminated in predetermined sequences and to enable the switch to stop a sequence.

The invention also relates to a method for making a capture-the-light game apparatus, the steps of the method including forming a housing having a plurality of separately mounted light sources in an extended arrangement, attaching a handle at each end portion of the housing, the handles being mounted to enable movement toward each other, mounting a compartment for a power source in one of the handles, mounting a controller in one of the handles, operatively connecting a switch to be activated by one of the handles, connecting the controller and the switch to each other and to the power source, and programming the controller to momentarily illuminate each of the plurality of light sources in predetermined sequences.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
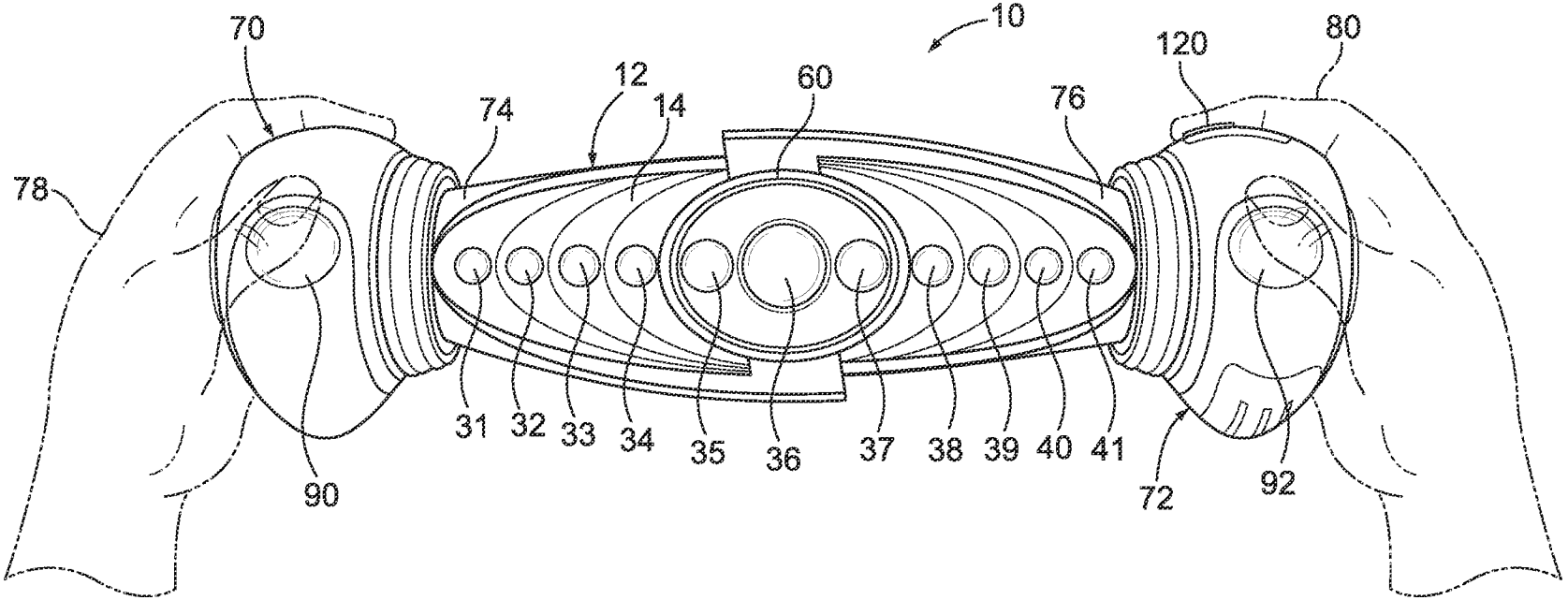
FIG. 1 is a front elevation view of a preferred embodiment of the present invention in the form of a hand held electronic game apparatus.
Figure 2:
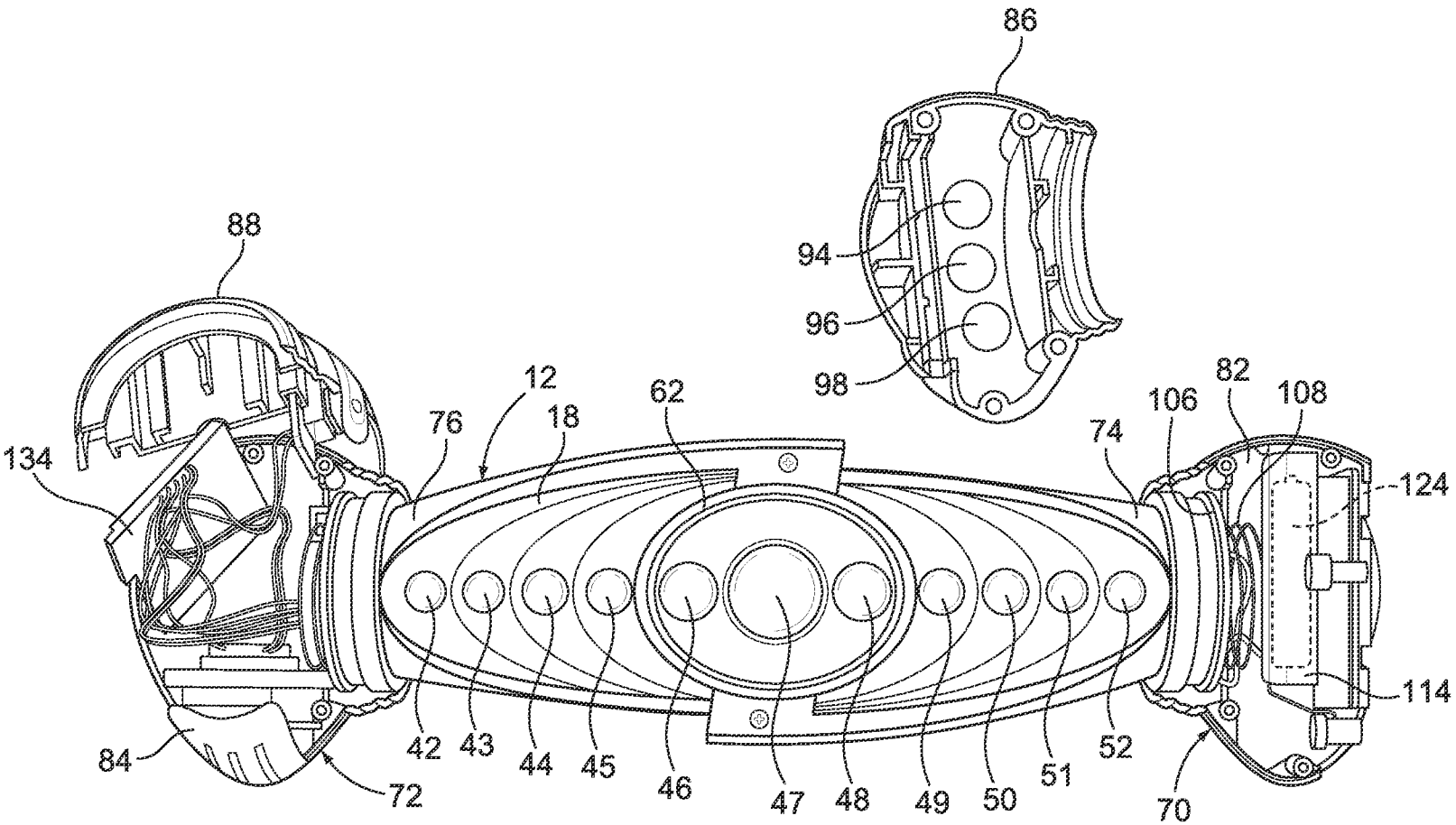
FIG. 2 is a rear elevation view of the game apparatus shown in FIG. 1, with open handles to show internal features.
Figure 3:
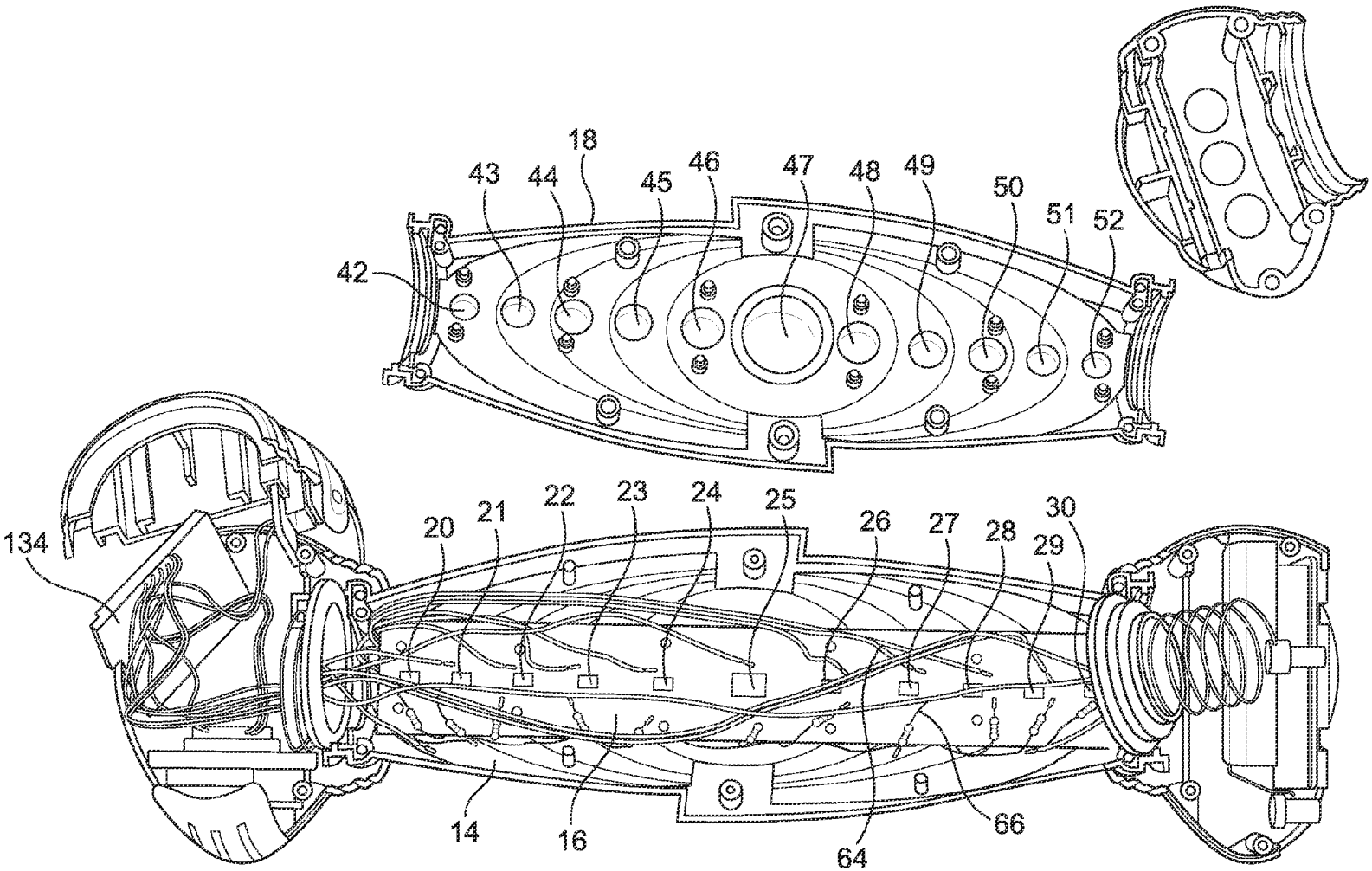
FIG. 3 is a rear elevation view of the game apparatus shown in FIG. 2, with an open housing.

Referring now to FIGS. 1-3, there is shown a preferred embodiment of the present invention in the form of a hand-held electronic game apparatus 10 in which a player wins or moves toward winning by "capturing" a light. The light capture game apparatus may include an elongated housing and two handles mounted at opposite ends of the housing. The housing includes a plurality of individual light sources that may be the eleven light sources, as shown. The game apparatus momentarily energizes or illuminates the individual light sources in predetermined sequences, and the object of the games played on the apparatus is for a player to quickly push the handles inward toward the housing to cause an operating sequence to stop at a predetermined light source when that light source is illuminated. If the illuminated light source is located at the desired location, a player is rewarded. If the light source illuminated when the sequence is interrupted is not at the desired location, the player is deemed to be unsuccessful and he/she receives no reward.

The housing 12 of the capture-the-light game apparatus 10 is elongated and stylistically designed and includes a front panel 14, a light bar 16, and a back panel 18. Mounted to the light bar 16 are a plurality of light sources, such as the eleven light sources 20, 21, 22, 23, 24, 25, 26, 27, 28, 29, 30, shown in FIG. 3. The light sources are arranged in an extended arrangement and may be linearly displayed. The light source may include light emitting diodes (LEDs). Each light source may also include a spherical diffuser, such as the diffusers 31, 32, 33, 34, 35, 36, 37, 38, 39, 40, 41, FIG. 1, mounted to the front panel 14, and the diffusers 42, 43, 44, 45, 46, 47, 48, 49, 50, 51, 52, FIG. 3, mounted to the back panel 18. The diffusers cause light from illuminated sources to appear as a relatively large balls of light to a player or viewer of the game apparatus. The center light source 25 may have a blue color and the other light sources may have a yellow color to indicate that the blue light source is the most desired location for a player to stop an operating light sequence provided that the blue light source is illuminated at the time. The housing 12 may be made of molded plastic and have an oval 60, 62 formed in the center of each panel 14, 18. Each oval design 60, 62, FIGS. 1 and 2, may enclose a "capture zone" formed of the center light source 25 and the two light sources 24, 26, adjacent the center light source. All three light sources may be desired as stopping objectives but the adjacent light sources 24, 26 may be less desired than the center light source 25. Each light source is connected by wires, such as the wires 64, 66 from the light source 27, FIG. 3, to other elements in the apparatus as will be described in detail below.

Figure 5:
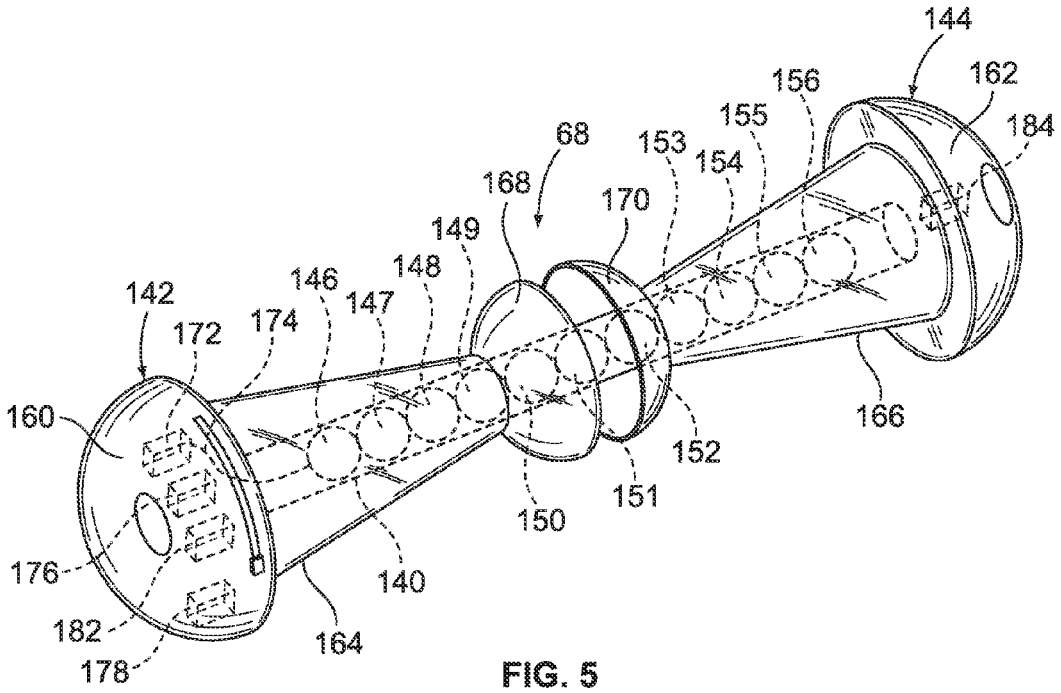
FIG. 5 is an isometric view of an alternative embodiment of the present invention, partially diagrammatic, and in an extended position.
Figure 6:
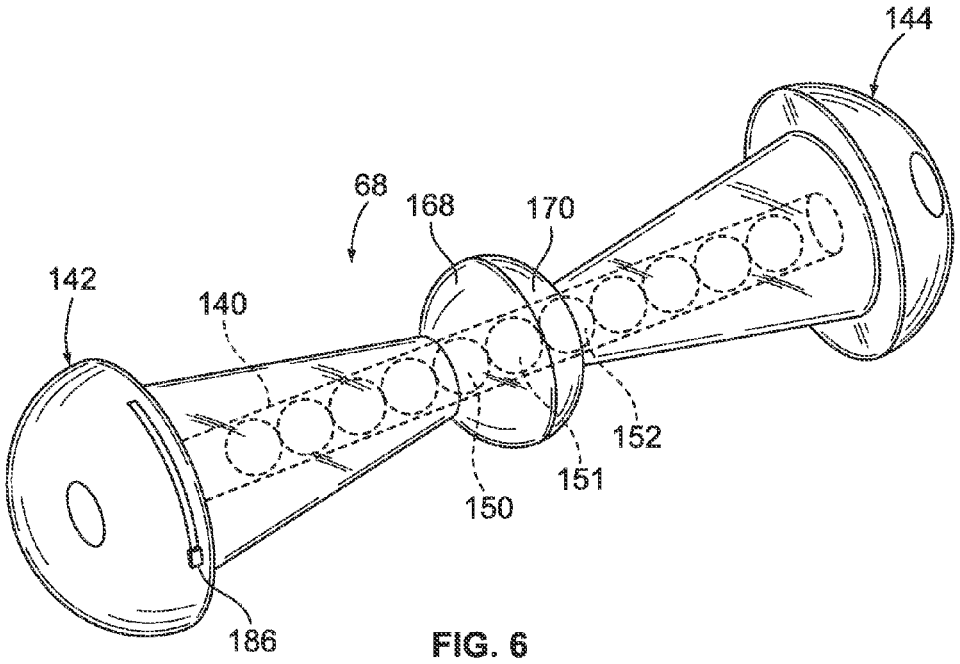
FIG. 6 is an isometric view of the alternative embodiment shown in FIG. 5, in a capture-the-light position.

In the alternative, the game apparatus may be styled differently, such as for example the game apparatus 68 shown in FIGS. 5 and 6. Also in the alternative, the arrangement of the light sources may be, for example, laid out in a curve or offset, such as in a saw-tooth pattern. Other light sources may be used instead of LEDs, and different colors may be chosen, or there may be no artificial colors.

In the games that may be played on the apparatus 10, detailed below, a player must capture the "moving light" when one of the three light sources in the capture zone ovals is illuminated. The moving light is created by illuminating the LEDs in predetermined sequences to create the illusion of light motion along the row of eleven LEDs. While no LED actually moves there is the perception of light movement back and forth along the housing when in fact the light sources are individually and momentarily energized in predetermine sequences with each light source being energized for a very short predetermined duration and at a predetermined tempo.

First and second handles 70, 72 may be movably connected to the housing 12 at opposite housing end portions 74,76. The handles are rounded, somewhat tear shaped, and sized so as to be easily and comfortably gripped by a player's hands 78, 80, as shown in phantom lines in FIG. 1. Each handle 70, 72 may also be formed of molded plastic in two parts, such as a front part 82, FIG. 2, of the handle 70 and a front part 84 of the handle 72. Each handle may also include a back part, such as the back part 86 of the handle 70 and the back part 88 of the handle 72. Slight depressions, such as thumb depressions 90, 92, FIG. 1, in the front parts 82, 84 of the handles 70,72, respectively, may be used to facilitate hand placement. Other depressions, such as the depressions 94, 96, 98, FIG. 2, seen from inside the handle back part 86 may be provided for fingers to be positioned once the thumbs of each hand is situated. Similar finger depressions (not shown) may be provided in the handle back part 88. The game apparatus 10 may be held in front of a player's chest, either while the player is standing or seated, using both hands so that he/she may easily see all of the light sources and yet freely swing his/her arms in rhythm to the tempo of the light sequences, if desired.

Figure 4:
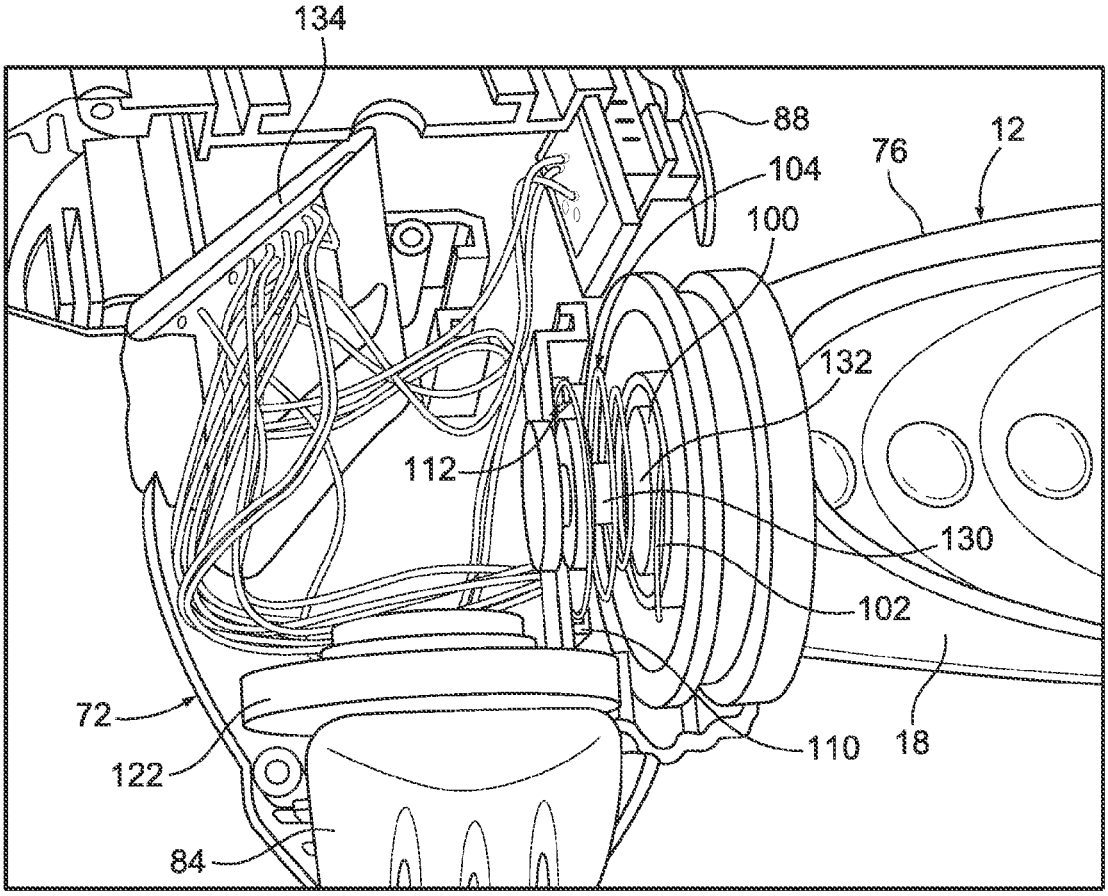
FIG. 4 is an enlarge view of the left hand handle shown in FIGS. 2 and 3.

Mounted to the housing end portion 76 is a spring seat 100, FIG. 4, for locating one end 102 of a first biasing element in the form of a compression spring 104. Mounted to the housing end portion 74 is another spring seat 106, FIG. 2, for locating one end of a second biasing element in the form of another compression spring 108. Located in the handle 72 is a spring seat 110, FIG. 4, for locating an opposite end 112 of the first compression spring 104, and located in the handle 70 is a battery compartment 114, FIG. 2, for locating an opposite end of the compression spring 108. The handles 70, 72 are mounted to the end portions 74, 76 of the housing 12 to enable the handles to move toward the housing and against the biasing forces of the springs 104, 108. The handle 72 may also mount a game selector and volume control button 120, FIG. 1. The multifunction button 120 may operate by being moved one way to act as a game selection switch, and by being moved the other way to step through three volume levels for a speaker 122, FIG. 4. Three batteries, such as the battery 124, may be used in the battery compartment to act a power source for the game apparatus.

Mounted in the handle 72 may be a switch actuator 130, FIG. 4, movable toward the housing 12 with the handle to press against a compression switch 132 mounted to the housing when a player desires to stop a light sequence in order to "capture the light." The handle 72 may also mount a controller 134, such as a microprocessor on a printed circuit board, well known to those skilled in the art, for controlling the game apparatus. The controller may also control the speaker 122 mounted in the handle 72 for generating electronic sounds and speech. The speaker may present a voice with an attitude. The voice may introduce a game, announce scores, and provide reactions to a player's successes and failures. The battery compartment 114, and thus the power source, is operatively connected to the switches 120, 132, the speaker 122, the printed circuit board 134, and the light sources 20, 21, 22, 23, 24, 25, 26, 27, 28, 29, 30 in a manner well known to those skilled in the art. When the game apparatus is sleeping, activation of compression switch 132 wakes the apparatus to start a new game. After a player operating the button 120 selects a game, activating the compression switch 132 may be used to confirm the game choice. Each game continues in a loop until the compression switch is activated. When the handles 70, 72 are brought toward each other, the compression switch 132 closes and the light sequence terminates, and the controller determines whether the player is rewarded and the manner in which the game proceeds. Each game loop may continue for twenty repetitions at which time the controller may treat the game as if the player failed to capture the light.

In the alternative, and again referring to FIGS. 5 and 6, another embodiment of the game apparatus is illustrated. The variant game apparatus 68 includes a housing 140 in the form of a light bar, shown in dotted lines, and opposing handles 142, 144. The light bar includes eleven light sources 146, 147, 148, 149, 150, 151, 152, 153, 154, 155, 156 to enable a "ball of light" to move back and forth along the light bar with a predetermined illumination duration and tempo. Each handle 142, 144 includes a semi-spherical handgrip 160, 162, a conically shaped arm 164, 166 and a cup shaped end portion 168, 170 that defines a capture zone when brought together as shown in FIG. 6. A controller 172, wires 174, a compression switch 176, a speaker 178 and biasing elements 182, 184 may be mounted within the handles and housing in a manner similar to that described for the embodiment shown in FIGS. 1-4. A game selector and volume control button 186 is shown as part of the handle 142. To capture a light successfully, the player must push the handles toward each other causing the cup like end portions 168, 170 to come together. The sphere shape formed by the end portions encloses the three light sources 150, 151, 152. If one of the three light sources is illuminated when the player pushes the handles together the player is successful, although capturing the center light source 151 may be more successful than capturing the light sources 150 or 152. If another light source is illuminated when the compression switch 176 is closed the player has failed.

As mentioned above, the object of the game that is played on the hand held electronic game apparatus is to capture the "light" at a preselected location on the light bar. For the games described in detail below, that pre-selected location is the capture zone within the ovals 60, 62, FIGS. 1 and 2. The game apparatus 10 is a game of skill and action that gives the illusion of a light moving along the row of eleven LEDs. For example, the game apparatus may be programmed to have each light source energized momentarily in a predetermined sequence from the light source 20 across the housing to the light source 30 and back again at a predetermined velocity, over and over again. The player is able to view the light sources and follow the predetermined sequence back and forth across the game apparatus, the pattern of on-and-off light sources appearing to the player as a ball of light moving across the game apparatus. The player may also hear a tune from the speaker timed to the light sequence which will allow him to sync his mind and body so as to attempt a "capture the light," that is, closing the compression switch 132 such that the light source illuminated at the moment the switch is closed is within the ovals.

If the compression switch is closed after the center light source 25 is illuminated and before it is de-energized, the player is most successful. If another capture zone light source is captured, either of the light sources 24 or 26, the player may be less successful, but successful nevertheless. For example, if the center light source 25 is captured the player may receive five points, a refresh of five lives and a chance at a bonus round, but if either the light source 24 or 26 is captured the player may receive only one point. However, if another light source, other than the three light sources just mentioned, is captured, the player is considered to have failed. If the player is successful he may hear accolades from the speaker, and/or a light show from the light sources as well as an audio announcement of his current score. Thereafter, the game apparatus may be programmed to move to a higher level that may present a more difficult light sequence. If the player has been unsuccessful he may hear a disparaging comment, he may lose one of the five lives given to all players at the start of a game. With the loss of all five lives the game ends. The type of games played on the game apparatus requires intense concentration, a major feature of the game apparatus and its games.

The controller may be programmed with two solo games and multi-player versions of the same two games. In operation, a player may start or wake the game apparatus by activating the compression switch. The player may manipulate the multifunctional button to one side to select a game and to the other side to adjust the volume of the speaker. Activating the compression switch may be used to confirm the game selection. Moving the button when the game is in sleep mode may wake the apparatus to start a new game. The button may also be used to program the number of players involved. A first game may have the light sequence moving from one end of the housing to the other without stopping, called a complete run. A second game may have light sequences that are less predictable, such as incomplete runs, pauses and reversals before reaching the end of the housing. The second game is designed to trick the player into pressing the compression switch at the wrong time.

Although the illumination sequences of the second game are less predictable, the movement of light is cyclical to enable players to learn and anticipate light movement so as to improve play. In each game there may be twenty levels of play. The level determines the velocity of illumination movement and the complexity of the light sequence. Players advance to a next level when a light capture occurs in the zone. The speaker may announce each new level. Each level may repeat until a capture is made or until there has been twenty repetitions of the sequence without action by a player. Each player may start a game with "five lives" or five changes to fail, and he may lose a life or chance when an attempted capture is made outside the capture zone. The lives or chances may determine the length of each game. When all of the lives or chances are gone before a cycle of twenty levels are completed the game is over and a score may be announced and/or displayed. A capture of the center light source may refresh all five lives or chances, while a capture of light in the capture zone, but not the center light source, may not provide a refresh of lives or chances. After an attempted capture, the number of lives or chances remaining for that player may be displayed by one or more of the first five light sources, starting at the left, and/or the speaker may announce the number of lives or chances remaining.

The bonus round may start after a short introduction and take the form of a ten second sequence consisting of a rapid and very unpredictable series of complete runs. The runs may be at a variety of velocities and one run may start before the end of a preceding run. A player may try to capture the light as often as he likes. A capture when the center light source only is illuminated may earn the player five points. The player may try for more captures, however, the light sequence does not loop and at the end of ten seconds the bonus round ends. Lives and levels may not be part of the bonus round.

A channel of audio may correspond to a playing light sequence, compression switch activation, and a response based on the result of an attempted capture. A second channel of audio may play a background melody in coordination with a playing light sequence to create a tempo, with a different melody for each level. The tempo may aid in timing a capture, may be irrelevant to capture, or may even be an intentional distraction.

By way of example, the games that may be played on the game apparatus may be a game for one player having twenty levels, with each new level being more difficult than the preceding level. The first five levels of this first game may have a tempo of 100 beats per minute and light source illumination duration of 0.06 seconds for the first two levels and illumination duration of 0.055 seconds for the next three levels. (For ease of understanding the light sources are renumber in the following examples from 1 to 11 which track the light sources 20, 21, 22, 23, 24, 25, 26, 27, 28, 29, 30, respectively, originally identified in relation to FIGS. 1-3. The blue center light source is now "5" instead of "25".) The light source illumination sequence at level one may be the following: 1, 2, 3, 4, 5, 6, 7, 8, 9, 10, 11, 10, 9, 8, 7, 6, 5, 4, 3, 2. Level two may have the following sequence: 1, 2, 3, 4, 5, 6, 7, 8, 9, 10, 11, 11, 11, 11, 11, low, low, low, low, low, 11, 11, 11, 11, 11, low, low, low, low, low, 11, 10, 9, 8, 7, 6, 5, 4, 3, 2. (The term "low" means that the light source is energized at only 50% of usual brightness.) Level three may feature two light sequences at the same time, with the first pattern being: 1, 2, 3, 4, 5, 6, 7, 8, 9, 10, 11, 10, 9, 8, 7, 6, 5, 4, 3, 2, and the second pattern being 11, 10, 9, 8, 7, off, 5, 4, 3, 2, 1, 2, 3, 4, 5, off, 7, 8, 9, 10. Level four may have the following sequence: 1, 2, 3, 4, 5, 6, 7, 8, 9, 10, 1, 2, 3, 4, 5, 6, 7, 8, 9, 10. The fifth level may have the following sequence: 1, 2, 3, 4, 5, 6, 7, 8, 9, 10, 11, 11, 11, 11, 11, 11, low, low, low, low, low, 11, 10, 9, 8, 7, 6, 5, 4, 3, 2, 1, 1, 1, 1, 1, low, low, low, low, low, 1, 2, 3, 4, 5, 6, 7, 8, 9, 10, 11, 10, 9, 8, 7, 6, 5, 4, 3, 2, 1, 1, 1, 1, 1, low, low, low, low, low, 1, 1, 1, 1, 1, low, low, low, low, low. It is noted that a successful capture moves the player to the next level and a capture of the center light source, the blue light, refreshes the player's lives back up to five.

The second five levels may be played with light source illumination duration of 0.045 seconds and a tempo of 120 beats per minute. The pattern at level six may be as follows: 1, 2, 3, 4, 5, 6, 7, 8, 9, 10, 11, 10, 9, 8, 7, 6, 5, 4, 3, 2. Level seven may have the following sequence: 1, 2, 3, 4, 5, 6, 7, 8, 9, 10, 11, 11, 11, 11, 11, low, low, low, low, low, 11, 11, 11, 11, 11, low, low, low, low, low, 11, 10, 9, 8, 7, 6, 5, 4, 3, 2. Level eight may sequence two light patterns at the same time, with the first pattern being: 11, 10, 9, 8, 7, 6, 5, 4, 3, 2, 1, 2, 3, 4, 5, 6, 7, 8, 9, 10, 11, 11, 11, 11, 11, low, low, low, low, low, and the second pattern being 1, 2, 3, 4, 5, 6, 7, 8, 9, 10, 11 10, 9, 8, 7, 6, 5, 4, 3, 2, 1, 1, 1, 1, 1, low, low, low, low, low. The ninth level may have the following sequence: 11, 10, 9, 8, 7, 6, 5, 4, 3, 2, 11, 10, 9, 8, 7, 6, 5, 4, 3, 2. Level ten may have the following sequence: 1, 2, 3, 4, 5, 6, 7, 8, 9, 10, 11, 11, 11, 11, 11, low, low, low, low, low, 11, 10, 9, 8, 7, 6, 5, 4, 3, 2, 1, 1, 1, 1, 1, low, low, low, low, low, 1, 1, 1, 1, 1, low, low, low, low, low, 1, 1, 1, 1, 1, low, low, low, low, low, 1, 2, 3, 4, 5, 6, 7, 8, 9, 10, 11, 10, 9, 8, 7, 6, 5, 4, 3, 2.

The third five levels, levels eleven to fifteen, may be played with light source excitation duration of 0.04 seconds and a tempo of 150 beats per minute. The pattern at level eleven may be as follows: 1, 2, 3, 4, 5, 6, 7, 8, 9, 10, 11, 10, 9, 8, 7, 6, 5, 4, 3, 2. Level twelve may have the following sequence: 1, 2, 3, 4, 5, 6, 7, 8, 9, 10, 11, 11, 11, 11, 11, low, low, low, low, low, 11, 11, 11, 11, 11, low, low, low, low, low, 11, 10, 9, 8, 7, 6, 5, 4, 3, 2. The thirteenth level may sequence two light patterns at the same time, with the first pattern being: 11, 10, 9, 8, 7, 6, 5, 4, 3, 2, 1, 2, 3, 4, 5, 6, 7, 8, 9, 10, 11, 11, 11, 11, 11, low, low, low, low, low, 11, 10, 9, 8, 7, 6, 5, 4, 3, 2, 1, 2, 3, 4, 5, 6, 7, 8, 9, 10, 11, 10, 9, 8, 7, 6, 5, 4, 3, 2, 11, 10, 9, 8, 7, 6, 5, 4, 3, 2, 1, 1, 1, 1, 1, low, low, low, low, and the second pattern being: 1, 2, 3, 4, 5, 6, 7, 8, 9, 10, 11, 10, 9, 8, 7, 6, 5, 4, 3, 2, 1, 1, 1, 1, 1, low, low, low, low, low, 1, 2, 3, 4, 5, 6, 7, 8, 9, 10, 11, 10, 9, 8, 7, 6, 5, 4, 3, 2, 1, 2, 3, 4, 5, 6, 7, 8, 9, 10, 1, 2, 3, 4, 5, 6, 7, 8, 9, 10, 11, 11, 11, 11, 11, low, low, low, low, low. Level fourteen may have the following pattern: 1, 2, 3, 4, 5, 6, 7, 8, 9, 10, 1, 2, 3, 4, 5, 6, 7, 8, 9, 10, 11, 11, 11, 11, 11, low, low, low, low, low, 11, 11, 11, 11, 11, low, low, low, low, low, 11, 10, 9, 8, 7, 6, 5, 4, 3, 2, 11, 10, 9, 8, 7, 6, 5, 4, 3, 2, 1, 1, 1, 1, 1, low, low, low, low, low. The sequence for level fifteen may be the following: 1, 2, 3, 4, 5, 6, 7, 8, 9, 10, 11, 11, 11, 11, 11, 11, low, low, low, low, low, 11, 10, 9, 8, 7, 6, 5, 4, 3, 2, 1, 1, 1, 1, 1, low, low, low, low, low, 1, 2, 3, 4, 5, 6, 7, 8, 9, 10, 11, 10, 9, 8, 7, 6, 5, 4, 3, 2.

The fourth and last five levels may be played with a light source illumination duration of 0.035 seconds for levels sixteen and seventeen, a duration of 0.03 seconds for levels eighteen and nineteen, and a duration of 0.02 seconds for level twenty, and a tempo of 170 beats per minute for all five levels. The sequence at level sixteen may be as follows: 1, 2, 3, 4, 5, 6, 7, 8, 9, 10, 11, 10, 9, 8, 7, 6, 5, 4, 3, 2. Level seventeen may have the following sequence: 1, 2, 3, 4, 5, 6, 7, 8, 9, 10, 11, 11, 11, 11, 11, low, low, low, low, low, 11, 10, 9, 8, 7, 6, 5, 4, 3, 2. Level eighteen may sequence two light patterns at the same time, with the first pattern being: 11, 10, 9, 8, 7, 6, 5, 4, 3, 2, 1, 2, 3, 4, 5, 6, 7, 8, 9, 10, 11, 11, 11, 11, 11, low, low, low, low, low, 11, 10, 9, 8, 7, 6, 5, 4, 3, 2, 1, 2, 3, 4, 5, 6, 7, 8, 9, 10, 11, 10, 9, 8, 7, 6, 5, 4, 3, 2, 11, 11, 11, 11, 11, low, low, low, low, low, and the second pattern being: 1, 2, 3, 4, 5, 6, 7, 8, 9, 10, 11, 10, 9, 8, 7, 6, 5, 4, 3, 2, 1, 1, 1, 1, 1, low, low, low, low, low, 1, 2, 3, 4, 5, 6, 7, 8, 9, 10, 11, 10, 9, 8, 7, 6, 5, 4, 3, 2, 1, 2, 3, 4, 5, 6, 7, 8, 9, 10, 1, 1, 1, 1, 1, low, low, low, low, low. Level nineteen may have the following pattern: 1, 2, 3, 4, 5, 6, 7, 8, 9, 10, 1, 2, 3, 4, 5, 6, 7, 8, 9, 10, 11, 11, 11, 11, 11, low, low, low, low, low, 11, 11, 11, 11, 11, low, low, low, low, low, 11, 11, 11, 11, 11, low, low, low, low, low 11, 10, 9, 8, 7, 6, 5, 4, 3, 2, 11, 10, 9, 8, 7, 6, 5, 4, 3, 2. The sequence for level twenty may be the following: 1, 2, 3, 4, 5, 6, 7, 8, 9, 10, 11, 11, 11, 11, 11, 11, low, low, low, low, low, 11, 10, 9, 8, 7, 6, 5, 4, 3, 2, 1, 1, 1, 1, 1, low, low, low, low, low, 1, 1, 1, 1, 1, low, low, low, low, low, 1, 2, 3, 4, 5, 6, 7, 8, 9, 10, 11, 10, 9, 8, 7, 6, 5, 4, 3, 2, 1, 2, 3, 4, 5, 6, 7, 8, 9, 10, 11, 11, 11, 11, 11, low, low, low, low, low, 11, 10, 9, 8, 7, 7, 6, 5, 4, 3, 2, 1, 1, 1, 1, 1, low, low, low, low, low.

The first five levels of a second more difficult game may be played with a light source illumination duration of 0.06 seconds for the first two levels, a duration of 0.055 for the next two levels, and a duration of 0.05 for the fifth level, and a tempo of 100 beats per minute for all five levels. The first level may have the following sequence: 1, 2, 3, 4, 4, low, low, low, low, low, 4, 4, 4, 4, 4, low, low, low, low, low, 5, 6, 7, 8, 9, 10, 11, low, low, low, 11, 11, 11, 11, 11, low, low, low, low, low, 11, 10, 9, 8, 7, 6, 5, 4, 3, 2, 1, 2, 3, 4, 5, 6, 7, 8, 9, 10, 11, 10, 9, 8, 7, 6, 5, 4, 3, 2, 1, 1, 1, 1, 1, low, low, low, low, low. The second level may have the following sequence: 1, 2, 3, 4, 5, 6, 7, 8, 9, 10, 11, 11, 11, 11, 11, low, low, low, low, low, 11, 10, 9, 8, 7, 6, 7, 8, 9, 10, 11, 11, 11, 11, 11, low, low, low, low, low, 11, 10, 9, 8, 7, 6, 5, 4, 3, 2, 1, 1, 1, 1, 1, low, low, low, low, low, 1, 2, 3, 4, 5, 6, 5, 4, 3, 2, 1, 1, 1, 1, 1, low, low, low, low, low. The pattern for the third level may be as follows: 1, 2, 3, 4, 4, low, low, low, low, low, 4, 4, 4, 4, 4, low, low, low, low, low, 4, 4, 4, 5, 6, 7, 8, 9, 10, 11, 11, 10, 9, 8, 7, 6, 5, 4, 3, 2. The fourth level may have the following pattern: 1, 2, 3, 4, 4, 4, 4, 4, 3, 2, 1, 2, 3, 4, 5, 6, 7, 8, 9, 10, 11, 10, 9, 8, 8, 8, 8, 8, 9, 10, 11, 10, 9, 8, 7, 6, 5, 4, 3, 2. The fifth level may have the following pattern: 1, 2, 3, 4, 5, 6, 7, 8, 9, 10, 11, 10, 9, 8, 8, 8, 8, 8, 9, 10, 11, 10, 9, 8, 8, 8, 8, 8, 9, 10, 11, 10, 9, 8, 7, 6, 5, 4, 3, 2.

The second five levels of the more difficult game may be played with light source excitation duration of 0.045 seconds and a tempo of 120 beats per minute. The sixth level may have the following sequence: 1, 2, 3, 4, 4, low, low, low, low, low, 4, 4, 4, 4, 4, low, low, low, low, low, 5, 6, 7, 8, 9, 10, 11, low, low, low, 11, 11, 11, 11, 11, low, low, low, low, low, 11, 10, 9, 8, 7, 6, 5, 4, 3, 2, 1, 2, 3, 4, 5, 6, 7, 8, 9, 10, 11, 10, 9, 8, 7, 6, 5, 4, 3, 2, 1, 1, 1, 1, 1, low, low, low, low, low. The seventh level may have the following pattern: 1, 2, 3, 4, 5, 6, 7, 8, 9, 10, 11, 11, 11, 11, 11, low, low, low, low, low, 11, 10, 9, 8, 7, 6, 7, 8, 9, 10, 11, 11, 11, 11, 11, low, low, low, low, low, 11, 10, 9, 8, 7, 6, 5, 4, 3, 2, 1, 1, 1, 1, 1, low, low, low, low, low, 1, 2, 3, 4, 5, 6, 5, 4, 3, 2, 1, 1, 1, 1, 1, low, low, low, low, low. The eighth level may have the following pattern: 1, 2, 3, 4, 4, low, low, low, low, low, 4, 4, 4, 4, 4, low, low, low, low, low, 4, 4, 4, 4, 4, low, low, low, low, low, 4, 5, 6, 7, 4, 8, 9, 10, 11, 11, 1, 2, 3, 4, low, low, low, low, low, low, 4, 5, 6, 7, 4, 8, 9, 10, 11, 11. The sequence for the ninth level may be the following: 1, 2, 3, 4, 4, 4, 4, 4, 3, 2, 1, 2, 3, 4, 5, 6, 7, 8, 9, 10, 11, 10, 9, 8, 8, 8, 8, 8, 9, 10, 11, 10, 9, 8, 7, 6, 5, 4, 3, 2. The tenth level may have the following sequence: 1, 2, 3, 4, 5, 6, 7, 8, 9, 10, 11, 10, 9, 8, 8, 8, 8, 8, 9, 10, 11, 10, 9, 8, 8, 8, 8, 8, 9, 10, 11, 10, 9, 8, 7, 6, 5, 4, 3, 2.

The third five levels of the more difficult game may be played with momentary excitation duration of 0.04 seconds and a tempo of 150 beats per minute. The eleventh level may have the following pattern: 1, 2, 3, 4, 4, low, low, low, low, low, 4, 4, 4, 4, 4, low, low, low, low, low, 5, 6, 7, 8, 9, 10, 11, low, low, low, 11, 11, 11, 11, 11, low, low, low, low, low, 11, 10, 9, 8, 7, 6, 5, 4, 3, 2, 1, 2, 3, 4, 5, 6, 7, 8, 9, 10, 11, 10, 9, 8, 7, 6, 5, 4, 3, 2, 1, 1, 1, 1, 1, low, low, low, low, low. The twelfth level may have the following sequence: 1, 2, 3, 4, 5, 6, 7, 8, 9, 10, 11, 11, 11, 11, 11, low, low, low, low, low, 11, 10, 9, 8, 7, 6, 7, 8, 9, 10, 11, 11, 11, 11, 11, low, low, low, low, low, 11, 10, 9, 8, 7, 6, 5, 4, 3, 2, 1, 1, 1, 1, 1, low, low, low, low, low, 1, 2, 3, 4, 5, 6, 5, 4, 3, 2, 1, 1, 1, 1, 1, low, low, low, low, low. The pattern of the thirteenth level may be as follows: 1, 2, 3, 4, 4, low, low, low, low, low, 4, 4, 4, 4, 4, low, low, low, low, low, 4, 4, 4, 4, 4, low, low, low, low, low, 4, 5, 6, 7, 4, 8, 9, 10, 11, 11, 1, 2, 3, 4, low, low, low, low, low, low, 4, 5, 6, 7, 4, 8, 9, 10, 11, 11. The fourteenth level may have the following pattern: 1, 2, 3, 4, 4, 4, 4, 4, 3, 2, 1, 2, 3, 4, 5, 6, 7, 8, 9,10, 11, 10, 9, 8, 8, 8, 8, 8, 8, 9, 10, 11, 10, 9, 8, 7, 6, 5, 4, 3, 2. The fifteenth level may have the following pattern: 1, 2, 3, 4, 5, 6, 7, 8, 9, 10, 11, 10, 9, 8, 8, 8, 8, 8, 9, 10, 11, 10, 9, 8, 8, 8, 8, 8, 9, 10, 11, 10, 9, 8, 7, 6, 5, 4, 3, 2.

The last five levels of the more difficult game may be played with an illumination duration of 0.035 seconds for levels sixteen and seventeen, a duration of 0.03 for levels eighteen and nineteen, and a duration of 0.02 for level twenty, and a tempo of 100 beats per minute for all five levels. The sixteenth level may have the following pattern: 1, 2, 3, 4, 4, low, low, low, low, low, 4, 4, 4, 4, 4, low, low, low, low, low, 5, 6, 7, 8, 9, 10, 11, low, low, low, 11, 11, 11, 11, 11, low, low, low, low, low, 11, 10, 9, 8, 7, 6, 5, 4, 3, 2, 1, 2, 3, 4, 5, 6, 7, 8, 9, 10, 11, 10, 9, 8, 7, 6, 5, 4, 3, 2, 1, 1, 1, 1, 1, low, low, low, low, low. The seventeenth level may have the following sequence: 1, 2, 3, 4, 5, 6, 7, 8, 9, 10, 11, 11, 11, 11, 11, low, low, low, low, low, 11, 10, 9, 8, 7, 6, 7, 8, 9, 10, 11, 11, 11, 11, 11, low, low, low, low, low, 11, 10, 9, 8, 7, 6, 5, 4, 3, 2, 1, 1, 1, 1, 1, low, low, low, low, low, 1, 2, 3, 4, 5, 6, 5, 4, 3, 2, 1, 1, 1, 1, 1, low, low, low, low, low. The sequence for the eighteenth level may be the following: 1, 2, 3, 4, 4, low, low, low, low, low, 4, 4, 4, 4, 4, low, low, low, low, low, 4, 4, 4, 4, 4, low, low, low, low, low, 4, 5, 6, 7, 4, 8, 9, 10, 11, 11, 1, 2, 3, 4, low, low, low, low, low, low, 4, 5, 6, 7, 4, 8, 9, 10, 11, 11. The nineteenth level may have the following pattern: 1, 2, 3, 4, 4, 4, 4, 4, 3, 2, 1, 2, 3, 4, 5, 6, 7, 8, 9, 10, 11, 10, 9, 8, 8, 8, 8, 9, 10, 11, 10, 9, 8, 7, 6, 5, 4, 3, 2, 1, 1, 1, 1, 1, low, low, low, low, low. The twentieth level may have the following sequence: 1, 2, 3, 4, 5, 6, 7, 8, 9, 10, 11, 10, 9, 8, 8, 8, 8, 8, 9, 10, 11, 10, 9, 8, 8, 8, 8, 8, 9, 10, 11, 10, 9, 8, 7, 6, 5, 4, 3, 2, 1, 2, 3, 4, 4, 4, 4, 4, 3, 2, 1, 2, 3, 4, 5, 6, 7, 8, 9, 10, 11, 11, 11, 11, 11, low, low, low, low, low, 11, 10, 9, 8, 7, 6, 5, 4, 3, 2, 1, 2, 3, 4, 4, 4, 4, 4, 4, 4, 4, 4, 4, 4, 4, 4, 4, 4, 4, 4, 4, 4, 4, 4, 4, 4, 4, 4, 3, 2.

In the alternative, the various sequences or patterns may be altered from those disclosed by mixing those provided and/or creating new patterns or sequence segments. Also, point scores, the number of lives used, light source illumination durations and tempos may all be changed as desired. An objective of the invention is to create and maintain a high level of concentration and intensity to excite players of the game apparatus.

Figure 7:
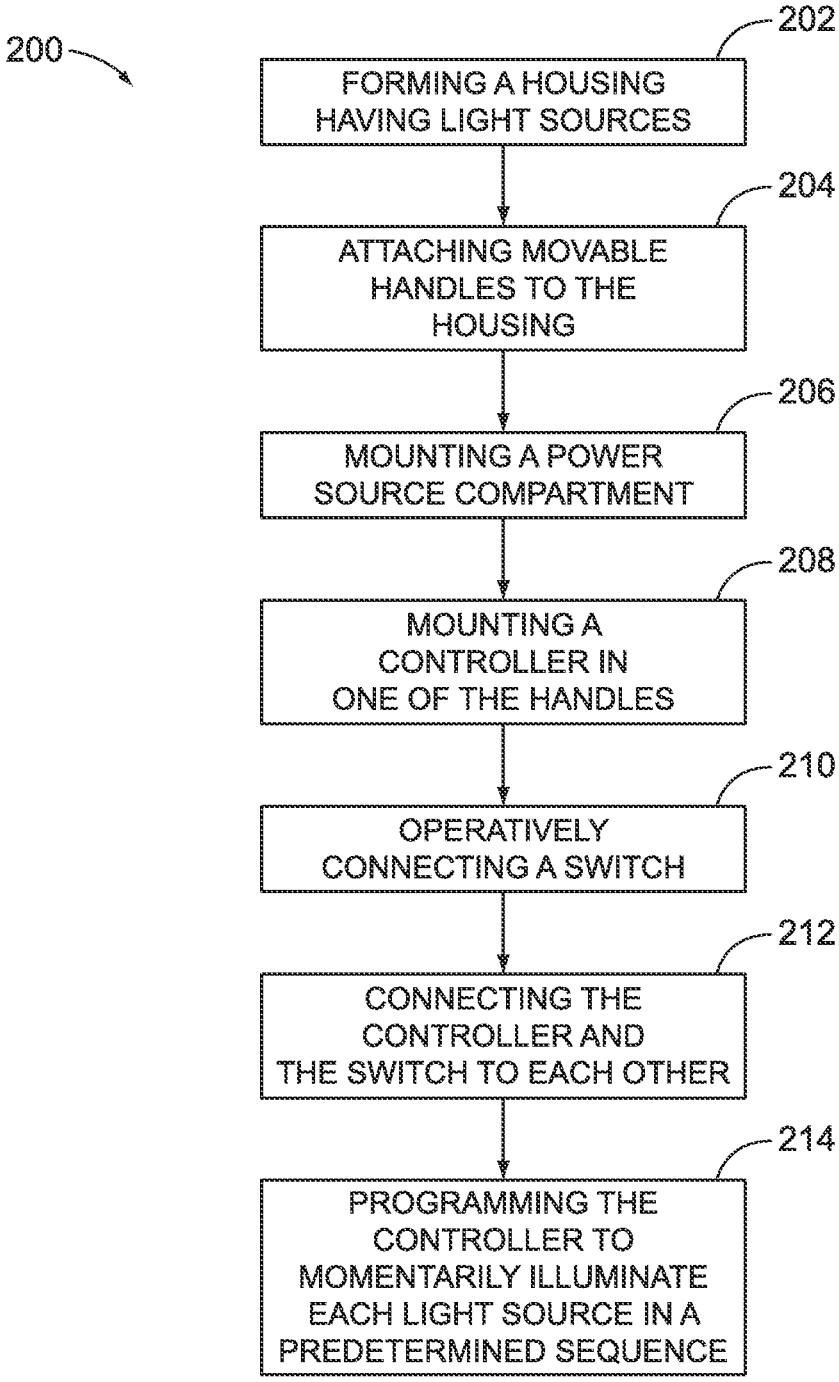
FIG. 7 is a flow diagram for a method of making the inventive game apparatus.

The present invention also includes a method for making a capture-the-light game apparatus, the steps of the method 200, FIG. 7, including forming a housing 202 with a longitudinal axis having a plurality of light sources in an extended arrangement, attaching a handle 204 at each end portion of the housing, the handles being mounted to enable movement parallel to the longitudinal axis of the housing, mounting a compartment 206 for a power source in one of the handles, mounting a controller 208 in one of the handles, operatively connecting a switch 210 to be activated by one of the handles, connecting the controller and the switch 212 to each other and to the power source, and programming the controller 214 to momentarily illuminate each or some of the plurality of light sources in predetermined sequences.

The game apparatus disclosed in detail above has great play value, is fun to play because of the concentration and intensity required, and is easy to operate in a safe manner, and yet the game apparatus has a robust, but simple structure, that may be produced at a reasonable cost.

From the foregoing, it can be seen that there has been provided features for an improved game apparatus and a disclosure for the method of the making the apparatus. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A capture-the-light game apparatus comprising:

a housing having a plurality of separately mounted light sources in an extended arrangement;

a first handle connected to the housing;

a first biasing element connected to the first handle and to the housing;

a second handle connected to the housing;

a switch operatively connected to the light sources, the switch being activated by a player of the game apparatus by movement of the first handle;

a compartment for mounting a power source, the compartment being operatively connected to the light sources and to the switch; and a controller operatively connected to the power source compartment, the switch and the light sources to enable the plurality of light sources to be illuminated in predetermined sequences and to enable the switch to stop a sequence.

2. The game apparatus of claim 1 including:

a speaker operatively connected to the controller.

3. The game apparatus of claim 1, wherein:

the biasing element is a first compression spring mounted at one end to the first handle and at an opposite end to the housing.

4. The game apparatus of claim 1, including:

a second biasing element connected to the second handle and to the housing.

5. The game apparatus of claim 1, wherein:

each of the plurality of separately mounted light sources includes a light diffuser and a light emitting diode.

6. The game apparatus of claim 1, wherein:

the housing is elongated and the light sources are mounted in a linear display.

7. The game apparatus of claim 1, wherein:

the controller is mounted in the first handle;

the switch is mounted to the housing; and the power source compartment is mounted in the second handle.

8. The game apparatus of claim 7, including:

a speaker mounted in the first handle and operatively connected to the controller.

9. The game apparatus of claim 8, wherein:

the plurality of light sources is eleven light sources mounted in a linear display.

10. The game apparatus of claim 1, including:

a speaker operatively connected to the controller; and a second biasing element connected to the second handle and to the housing; and wherein the first biasing element is a first compression spring mounted at one end to the first handle and at an opposite end to the housing.

11. The game apparatus of claim 10, wherein:

each of the plurality of separately mounted light sources includes a light diffuser and a light emitting diode.

12. The game apparatus of claim 11, wherein:

the housing is elongated and the light sources are mounted in a linear display;

the controller is mounted in the first handle;

the switch is mounted to the housing; and the power source compartment is mounted in the second handle; and including a speaker mounted in the first handle.

13. A hand-held electronic game apparatus comprising:

an elongated housing having a plurality of separately mounted light sources in a linear display;

a first handle movably connected to the housing;

a biasing element connected to the first handle and to the housing;

a second handle connected to the housing;

a switch operatively connected to the light sources, the switch being activated by a player of the game apparatus by movement of the first handle;

a compartment for mounting a power source, the compartment being operatively connected to the light sources and to the switch; and a controller connected to the power source compartment, the switch and the light sources to enable the plurality of light sources to be illuminated in predetermined sequences wherein a player is able to stop a sequence by activating the switch.

14. The game apparatus of claim 13, including:

a speaker operatively connected to the controller.

15. The game apparatus of claim 14, wherein:

the controller is mounted in the first handle;

the switch is mounted to the housing;

the power source compartment is mounted in the second handle; and the biasing element is a first compression spring mounted at one end to the first handle and at an opposite end to the housing; and including a second biasing element mounted at one end to the second handle and at an opposite end to the housing.

16. A method for making a capture-the-light game apparatus, the steps of the method comprising:

forming a housing having a plurality of separately mounted light sources in an extended arrangement;

attaching a handle at each end portion of the housing, the handles being mounted to enable movement toward each other;

mounting a compartment for a power source in one of the handles;

mounting a controller in one of the handles;

operatively connecting a switch to be activated by one of the handles;

connecting the controller and the switch to each other and to the power source; and programming the controller to momentarily illuminate each of the plurality of light sources in predetermined sequences, and to enable the switch to stop a sequence.

17. The method of claim 16, including the step of:

mounting a speaker to one of the handles.

18. The method of claim 17, including the step of:

mounting springs to the housing and to the handles.

19. The method of claim 18, wherein:

the switch is a compression switch operated by movement of a handle.

20. The method of claim 19, including the steps of:

mounting the controller in the first handle;

mounting the switch to the housing; and mounting the power source compartment in the second handle.

* * * * *